US010580354B2

(12) United States Patent
Wang et al.

(10) Patent No.: US 10,580,354 B2
(45) Date of Patent: Mar. 3, 2020

(54) SIGNAL COMPENSATOR, SIGNAL COMPENSATION METHOD AND SIGNAL COMPENSATION SYSTEM FOR DETERMINING AND COMPENSATING SIGNAL FROM SIGNAL GENERATOR TO DISPLAY PANEL

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Weiwei Wang, Beijing (CN); You Zheng, Beijing (CN); Wei Dai, Beijing (CN); Qing Wang, Beijing (CN); Xin You, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 32 days.

(21) Appl. No.: 15/966,653

(22) Filed: Apr. 30, 2018

(65) Prior Publication Data

US 2019/0012959 A1 Jan. 10, 2019

(30) Foreign Application Priority Data

Jul. 7, 2017 (CN) ..... 2017 1 0551723

(51) Int. Cl.
*G09G 3/3208* (2016.01)
*G09G 3/00* (2006.01)

(52) U.S. Cl.
CPC ..... *G09G 3/3208* (2013.01); *G09G 3/006* (2013.01); *G09G 2320/0242* (2013.01); *G09G 2320/043* (2013.01); *G09G 2330/12* (2013.01)

(58) Field of Classification Search
CPC combination set(s) only.
See application file for complete search history.

(56) References Cited

U.S. PATENT DOCUMENTS

2007/0182681 A1 8/2007 Kim
2013/0293594 A1* 11/2013 Kang ..... G09G 3/3406 345/690

(Continued)

FOREIGN PATENT DOCUMENTS

CN 101026709 A 8/2007
CN 201928080 U 8/2011

(Continued)

OTHER PUBLICATIONS

First Office Action for Chinese Application No. 201710551723.4, dated May 31, 2019, 8 Pages.

*Primary Examiner* — Lisa S Landis
(74) *Attorney, Agent, or Firm* — Brooks Kushman P.C.

(57) ABSTRACT

A signal compensator includes an abnormality identification unit and a signal compensation unit. The abnormality identification unit is configured to determine whether or not a waveform of a signal generated by a signal generator is abnormal, when the waveform of the signal is normal, output the signal to a display panel, and when the waveform of the signal is abnormal, stop outputting the signal to the display panel and send an instruction to the signal compensation unit. The signal compensation unit is configured to perform signal compensation on the display panel in accordance with the instruction received from the abnormality identification unit.

12 Claims, 4 Drawing Sheets

(56) References Cited

U.S. PATENT DOCUMENTS

| | | | | |
|---|---|---|---|---|
| 2014/0084792 | A1* | 3/2014 | Oh | H05B 37/02<br>315/120 |
| 2018/0174542 | A1 | 6/2018 | Zheng et al. | |

FOREIGN PATENT DOCUMENTS

| | | | |
|---|---|---|---|
| CN | 103021355 | A | 4/2013 |
| CN | 103236242 | A | 8/2013 |
| CN | 103904770 | A | 7/2014 |
| CN | 105679230 | A | 6/2016 |
| CN | 205355941 | U | 6/2016 |

* cited by examiner

SIGNAL COMPENSATOR, SIGNAL COMPENSATION METHOD AND SIGNAL COMPENSATION SYSTEM FOR DETERMINING AND COMPENSATING SIGNAL FROM SIGNAL GENERATOR TO DISPLAY PANEL

CROSS-REFERENCE TO RELATED APPLICATION

This application claims priority to Chinese Patent Application No. 201710551723.4 filed on Jul. 7, 2017, which is incorporated herein by reference in its entirety.

TECHNICAL FIELD

The present disclosure relates to the field of testing technology, in particular to a signal compensator, a signal compensation method and a signal compensation system.

BACKGROUND

For a test process, e.g., a high-temperature aging test process for improving stability and reliability of a display product, it is necessary to provide, by signal generators, aging test signals (including a power source signal and an image display signal) to the display product in waveforms. However, it is very difficult to ensure that each signal generator is capable of outputting the signal normally. If the signal generator outputs an abnormal signal, display abnormalities (e.g., ghost image and abnormal grayscale) may occur.

SUMMARY

An object of the present disclosure is to provide a signal compensator, a signal compensation method and a signal compensation system, so as to prevent the occurrence of the display abnormalities in the case that the signals are generated by the signal generators to a display panel.

In one aspect, the present disclosure provides in some embodiments a signal compensator, including an abnormality identification unit and a signal compensation unit. The abnormality identification unit is configured to determine whether or not a waveform of a signal generated by a signal generator is abnormal, when the waveform of the signal is normal, output the signal to a display panel, and when the waveform of the signal is abnormal, stop outputting the signal to the display panel and send an instruction to the signal compensation unit. The signal compensation unit is configured to perform signal compensation on the display panel in accordance with the instruction received from the abnormality identification unit.

In a possible embodiment of the present disclosure, the signal generated by the signal generator includes a power source signal and an image display signal.

In a possible embodiment of the present disclosure, the abnormality identification unit includes a first abnormality identification unit, and the signal compensation unit includes a first signal compensation unit. The first abnormality identification unit is configured to determine whether or not a waveform of the power source signal generated by the signal generator is abnormal, when the waveform of the power source signal is normal, output the power source signal to the display panel, and when the waveform of the power source signal is abnormal, stop outputting the power source signal and send an instruction to the first signal compensation unit. The first signal compensation unit is configured to output a signal same as the power source signal to the display panel in accordance with the instruction received from the first abnormality identification unit.

In a possible embodiment of the present disclosure, the waveform of the power source signal is a waveform of a direct-current power source signal, and abnormalities of the waveform of the power source signal includes at least one of the followings: a time period within which a waveform value of the power source signal increases to a stable value from zero exceeds a first threshold after power supply is started; a time period within which the waveform value of the power source signal decreases to zero from the stable value exceeds a second threshold after the power supply is stopped; and the stable value of the waveform value of the power source signal is not within a standard range.

In a possible embodiment of the present disclosure, three VDD input pins of the first abnormality identification unit are connected to three VDD output ends of the signal generator respectively, three VDD output pins thereof are connected to three VDD input ends of the display panel respectively, a data signal pin thereof is connected to a data signal pin of the first signal compensation unit, and a clock signal pin thereof is connected to a clock signal pin of the first signal compensation unit. Three VDD output pins of the first signal compensation unit are connected to the three VDD input ends of the display panel respectively.

In a possible embodiment of the present disclosure, the abnormality identification unit includes a second abnormality identification unit, and the signal compensation unit includes a second signal compensation unit. The second abnormality identification unit is configured to determine whether or not a waveform of the image display signal generated by the signal generator is abnormal, when the waveform of the image display signal is normal, output the image display signal to the display panel, and when the waveform of the image display signal is abnormal, stop outputting the image display signal and send an instruction to the second signal compensation unit. The second signal compensation unit is configured to send an instruction for enabling a built-in self-test (BIST) mode to the display panel in accordance with the instruction received from the second abnormality identification unit.

In a possible embodiment of the present disclosure, the waveform of the image display signal is a waveform of a low-voltage differential signal. Abnormalities of the waveform of the low-voltage differential signal include at least one of the followings: that a frequency of the waveform of the low-voltage differential signal is not within a standard frequency range; that a peak value of a waveform value of the low-voltage differential signal is not within a standard peak value range; and that a valley value of the waveform value of the low-voltage differential signal is not within a standard valley value range.

In a possible embodiment of the present disclosure, a signal input end of the second abnormality identification unit is connected to four sets of low-voltage differential signal ends and a set of clock signal ends of the signal generator, a signal output end thereof is connected to four sets of low-voltage differential signal ends and a set of clock signal ends of the display panel, a data signal pin thereof is connected to a data signal pin of the second signal compensation unit, and a clock signal pin thereof is connected to a clock signal pin of the second signal compensation unit. An output pin of the second signal compensation unit is connected to a BIST pin of the display panel.

In another aspect, the present disclosure provides in some embodiments a signal compensation system, including a signal generator, a display panel and the above-mentioned signal compensator.

In a possible embodiment of the present disclosure, the signal compensator is built in the signal generator.

In a possible embodiment of the present disclosure, the signal compensator includes a first abnormality identification unit, a first signal compensation unit, a second abnormality identification unit and a second signal compensation unit. Three VDD input pins of the first abnormality identification unit are connected to three VDD output ends of the signal generator respectively, three VDD output pins thereof are connected to three VDD input ends of the display panel respectively, a data signal pin thereof is connected to a data signal pin of the first signal compensation unit, and a clock signal pin thereof is connected to a clock signal pin of the first signal compensation unit. Three VDD output pins of the first signal compensation unit are connected to the three VDD input ends of the display panel respectively, and a VCC power supply pin thereof is connected to a VCC output end of the signal generator. A signal input end of the second abnormality identification unit is connected to four sets of low-voltage differential signal ends and a set of clock signal ends of the signal generator, a signal output end thereof is connected to four sets of low-voltage differential signal ends and a set of clock signal ends of the display panel, a data signal pin thereof is connected to a data signal pin of the second signal compensation unit, and a clock signal pin thereof is connected to a clock signal pin of the second signal compensation unit. An output pin of the second compensation unit is connected to a BIST pin of the display panel, and a VCC power supply pin thereof is connected to the VCC output end of the signal generator.

In a possible embodiment of the present disclosure, the first abnormality identification unit, the second abnormality identification unit, the first signal compensation unit and the second signal compensation unit are implemented through an integrated circuit (IC) chip.

In yet another aspect, the present disclosure provides in some embodiments a signal compensation method, including steps of: determining whether or not a waveform of a signal generated by a signal generator is abnormal, when the waveform of the signal is normal, outputting the signal to a display panel, and when the waveform of the signal is abnormal, stopping outputting the signal to the display panel and sending an instruction; and performing signal compensation on the display panel in accordance with the received instruction.

In a possible embodiment of the present disclosure, when a power source signal is generated by the signal generator, the step of performing the signal compensation on the display panel includes outputting a signal same as the power source signal to the display panel.

In a possible embodiment of the present disclosure, when an image display signal is generated by the signal generator, the step of performing the signal compensation on the display panel incudes sending an instruction for enabling a BIST mode to the display panel.

DETAILED DESCRIPTION

The present disclosure will be described hereinafter in more details in conjunction with the drawings and embodiments.

Figure 1:
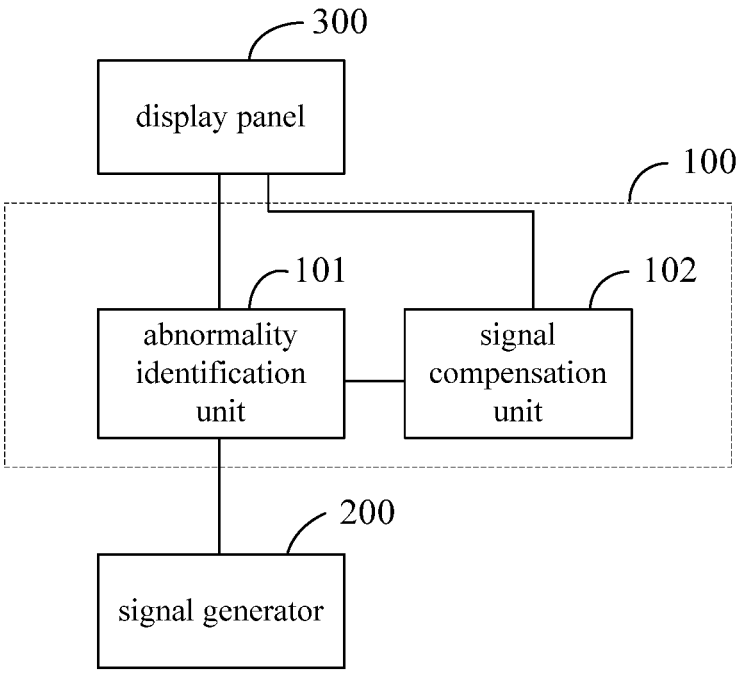
FIG. 1 is a schematic view showing a signal compensator according to one embodiment of the present disclosure.

As shown in FIG. 1, the present disclosure provides in some embodiments a signal compensator 100 for a system including a signal generator 200 and a display panel 300. The signal generator 200 is configured to generate a signal for the display panel 300. The signal compensator 100 includes an abnormality identification unit 101 and a signal compensation unit 102. The abnormality identification unit 101 is configured to determine whether or not a waveform of the signal generated by the signal generator 200 is abnormal, when the waveform of the signal is normal, output the signal to the display panel 300, and when the waveform of the signal is abnormal, stop outputting the signal to the display panel 300 and send an instruction to the signal compensation unit 102. The signal compensation unit 102 is configured to perform signal compensation on the display panel 300 in accordance with the instruction received from the abnormality identification unit 101.

According to the signal compensator in the embodiments of the present disclosure, when the waveform of the signal generated by the signal generator for the display panel is abnormal, the signal is not outputted to the display panel, and the signal compensation is performed for the display panel. As a result, it is able to output the normal signal to the display panel continuously and prevent the occurrence of display abnormalities due to the abnormal signal, thereby to improve the light-on test efficiency and the yield of the product.

It should be appreciated that, the signal compensator in the embodiments of the present disclosure may be applied to, but not limited to, an aging process. Further, the signal compensator may be applied to, but not limited to, the aging process for a thin film transistor liquid crystal display (TFT-LCD) panel and an organic light-emitting diode (OLED) display panel.

During the implementation, the signal generated by the signal generator includes a power source signal and an image display signal. The power source signal is a signal for supplying power to the display panel, and the image display signal is a signal for enabling the display panel to display an image. The signal compensation may be performed using the signal compensator with respect to different types of the signal.

Figure 2:
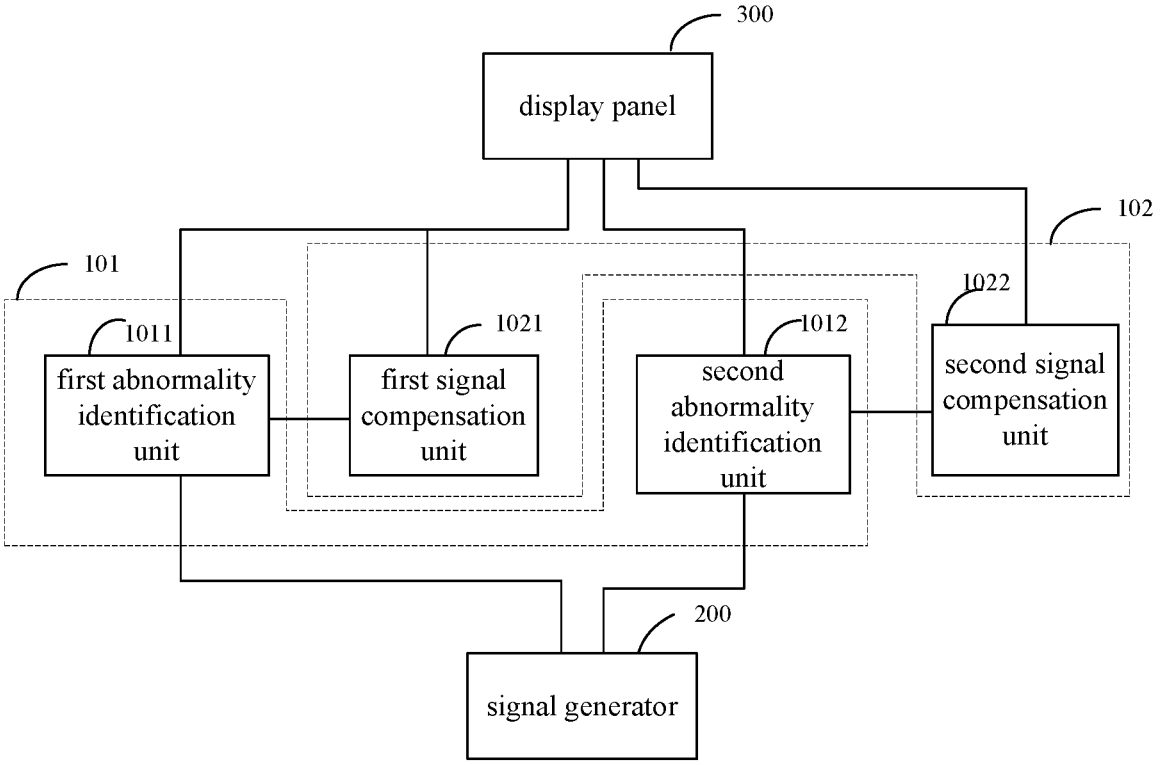
FIG. 2 is another schematic view showing a signal compensator according to one embodiment of the present disclosure.

During the implementation, as shown in FIG. 2, the abnormality identification unit 101 includes a first abnormality identification unit 1011, and the signal compensation unit 102 includes a first signal compensation unit 1021. The first abnormality identification unit 1011 is configured to determine whether or not a waveform of the power source signal generated by the signal generator 200 is abnormal, when the waveform of the power source signal is normal, output the power source signal to the display panel 300, and when the waveform of the power source signal is abnormal, stop outputting the power source signal and send an instruction to the first signal compensation unit 1021. The first signal compensation unit 1021 is configured to output a signal same as the power source signal to the display panel 300 in accordance with the instruction received from the first abnormality identification unit 1011.

In the embodiments of the present disclosure, the structures for determining whether or not the power source signal is abnormal and performing the signal compensation have been listed. When the waveform of the power source signal is determined to be abnormal, the signal same as the power source signal generated by the signal generator 200 may be outputted to the display panel 300, so as to output the normal power source signal to the display panel 300.

Figure 3:
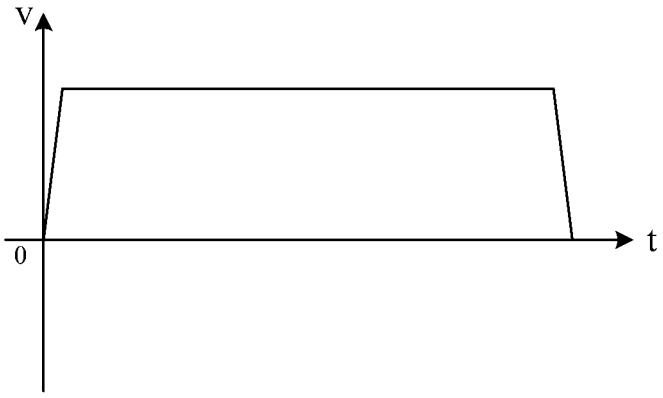
FIG. 3 is a schematic view showing a waveform of a power source signal according to one embodiment of the present disclosure.

During the implementation, the waveform of the power source signal is a waveform of a direct-current power source signal. As shown in FIG. 3, after power supply is started, a waveform value of the direct-current power source signal gradually increases from zero to a stable value within a certain time period, and after the power supply is stopped, the waveform value of the direct-current power source signal gradually decreases from the stable value to zero within a certain time period. If the time taken for the waveform value of the power source signal to increase or decrease is not within a range or the stable value of the waveform value of the power source signal is not within a standard range, it means that there is an abnormality, and thereby the display abnormality may occur for the display product. Taking a liquid crystal display device as an example, liquid crystals are deflected under the effect of a voltage difference between two electrodes, and a light transmittance depends on a deflection angle. If the liquid crystal display device has aged and the abnormal power source signal is generated for the liquid crystal display device, an abnormal voltage may be applied to the electrode. At this time, there is an abnormality for the voltage difference applied to the liquid crystals. If the liquid crystals are deflected under the effect of the voltage difference different from a voltage difference for a long term, such defects as ghost image and grayscale abnormality may occur.

Based on the above, the waveform of the power source signal may be the waveform of the direct-current power source signal, and the abnormalities of the waveform of the power source signal may include at least one of the followings: a time period within which the waveform value of the power source signal increases to the stable value from zero exceeds a first threshold after the power supply is started; a time period within which the waveform value of the power source signal decreases to zero from the stable value exceeds a second threshold after the power supply is stopped; and the stable value of the waveform value of the power source signal is not within a standard range. The standard range, the first threshold and the second threshold may be set in advance in accordance with the practical need.

During the implementation, the waveform of the power source signal may be determined as abnormal as long as any one of the above-mentioned abnormalities occurs, so as to improve the accuracy of the abnormality identification. Of course, any other scheme may also be used to determine the abnormalities.

In a possible embodiment of the present disclosure, as shown in FIG. 2, the abnormality identification unit 101 includes a second abnormality identification unit 1012, and the signal compensation unit 102 includes a second signal compensation unit 1022. The second abnormality identification unit 1012 is configured to determine whether or not a waveform of the image display signal generated by the signal generator 200 is abnormal, when the waveform of the image display signal is normal, output the image display signal to the display panel 300, and when the waveform of the image display signal is abnormal, stop outputting the image display signal and send an instruction to the second signal compensation unit 1022. The second signal compensation unit 1022 is configured to send an instruction for enabling a Build In Self Test (BIST) mode to the display panel 300 in accordance with the instruction received from the second abnormality identification unit 1021.

In the embodiments of the present disclosure, the structures for determining whether or not the image display signal is abnormal and performing the signal compensation have been listed. When the waveform of the image display signal is determined to be abnormal, the instruction for enabling the BIST mode may be sent to the display panel 300, so as to activate the BIST mode and enable the display panel to provide by itself the image display signal. In this way, it is able to control the display panel to enter a self-compensation mode, thereby to output the normal image display signal to the display panel.

Figure 4:
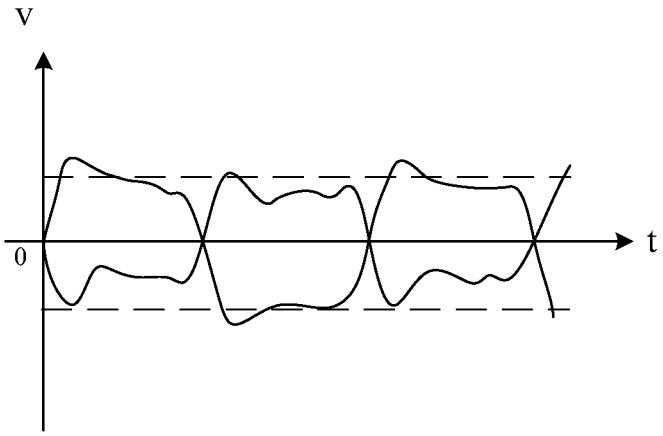
FIG. 4 is a schematic view showing a waveform of an image display signal according to one embodiment of the present disclosure.

During the implementation, the waveform of the image display signal is a waveform of the low-voltage differential signaling (LVDS) signal. As shown in FIG. 4, the LVDS signal is a signal transmitted at a high level and a low level alternately and having a certain frequency. In FIG. 4, a dotted line above represents a high level, and a dotted line below represents a low level. If any of the frequency as well as a peak value and a valley value of a waveform value of the LVDS signal is not within a certain range, it means that there is an abnormality which may probably be caused by an abnormality of an element of the signal generator or an abnormality of a signal transmission line. If the abnormality of the LVDS signal occurs, a grayscale abnormality may occur too.

Based on the above, the waveform of the image display signal is a waveform of the low-voltage differential signaling signal. Abnormalities of the waveform of the low-voltage differential signaling signal include at least one of the followings: the frequency of the waveform of the low-voltage differential signaling signal is not within a standard frequency range; the peak value of the waveform value of the low-voltage differential signaling signal is not within a standard peak value range; and the valley value of the waveform value of the low-voltage differential signaling signal is not within a standard valley value range. The standard frequency range, the standard peak value range and the standard valley value range may be set in advance in accordance with the practical need.

During the implementation, the waveform of the image display signal may be determined as abnormal as long as any one of the above-mentioned abnormalities occurs, so as to improve the accuracy of the abnormality identification. Of course, any other scheme may also be used to determine the abnormalities.

It should be appreciated that, different power source signals may be generated with respect to different types of the display panels. For example, a chip operating voltage VDD, a ground voltage VSS or a circuit supply voltage VCC may be applied, which will not be particularly defined herein.

Based on a same inventive concept, the present disclosure further provides in some embodiments a signal compensation system, including a signal generator, a display panel and the above-mentioned signal compensator. The signal compensator may be built in the signal generator.

Figure 5:
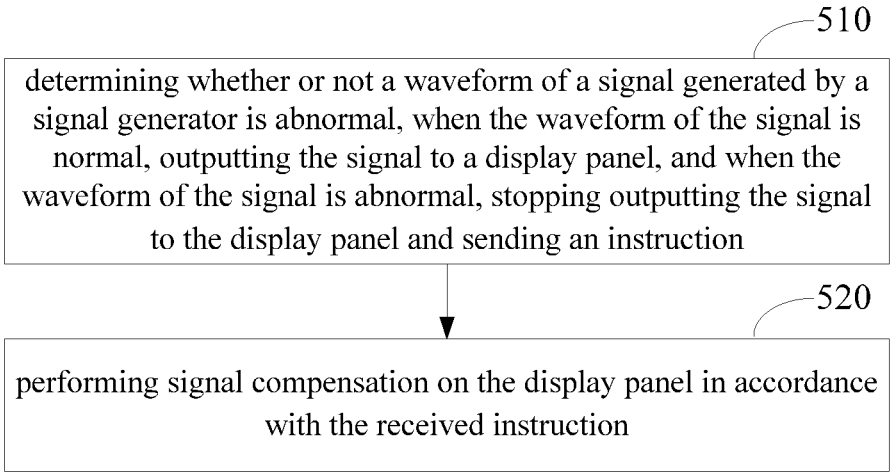
FIG. 5 is a flow chart of a signal compensation method according to one embodiment of the present disclosure.

Based on a same inventive concept, as shown in FIG. 5, the present disclosure further provides in some embodiments a signal compensation method for the above-mentioned signal compensator, which includes: Step 510 of determining whether or not a waveform of a signal generated by a signal generator is abnormal, when the waveform of the signal is normal, outputting the signal to a display panel, and when the waveform of the signal is abnormal, stopping outputting the signal to the display panel and sending an instruction; and Step 520 of performing signal compensation on the display panel in accordance with the received instruction.

According to the signal compensation method in the embodiments of the present disclosure, when the waveform of the signal generated by the signal generator for the display panel is determined as abnormal, the signal is not outputted to the display panel, and the signal compensation is performed on the display panel. As a result, it is able to output the normal signal to the display panel continuously and prevent the occurrence of display abnormalities due to the abnormal signal, thereby to improve the light-on test efficiency and the yield of the product.

A power source signal is generated by the signal generator, Step 520 may include performing signal compensation, that is outputting a signal same as the power source signal to the display panel. An image display signal is generated by the signal generator, Step 520 may include performing signal compensation, that is sending an instruction for enabling a BIST mode to the display panel.

The signal compensator, the signal compensation method and the signal compensation system in the embodiments of the present disclosure will be described hereinafter in more details.

Figure 6:
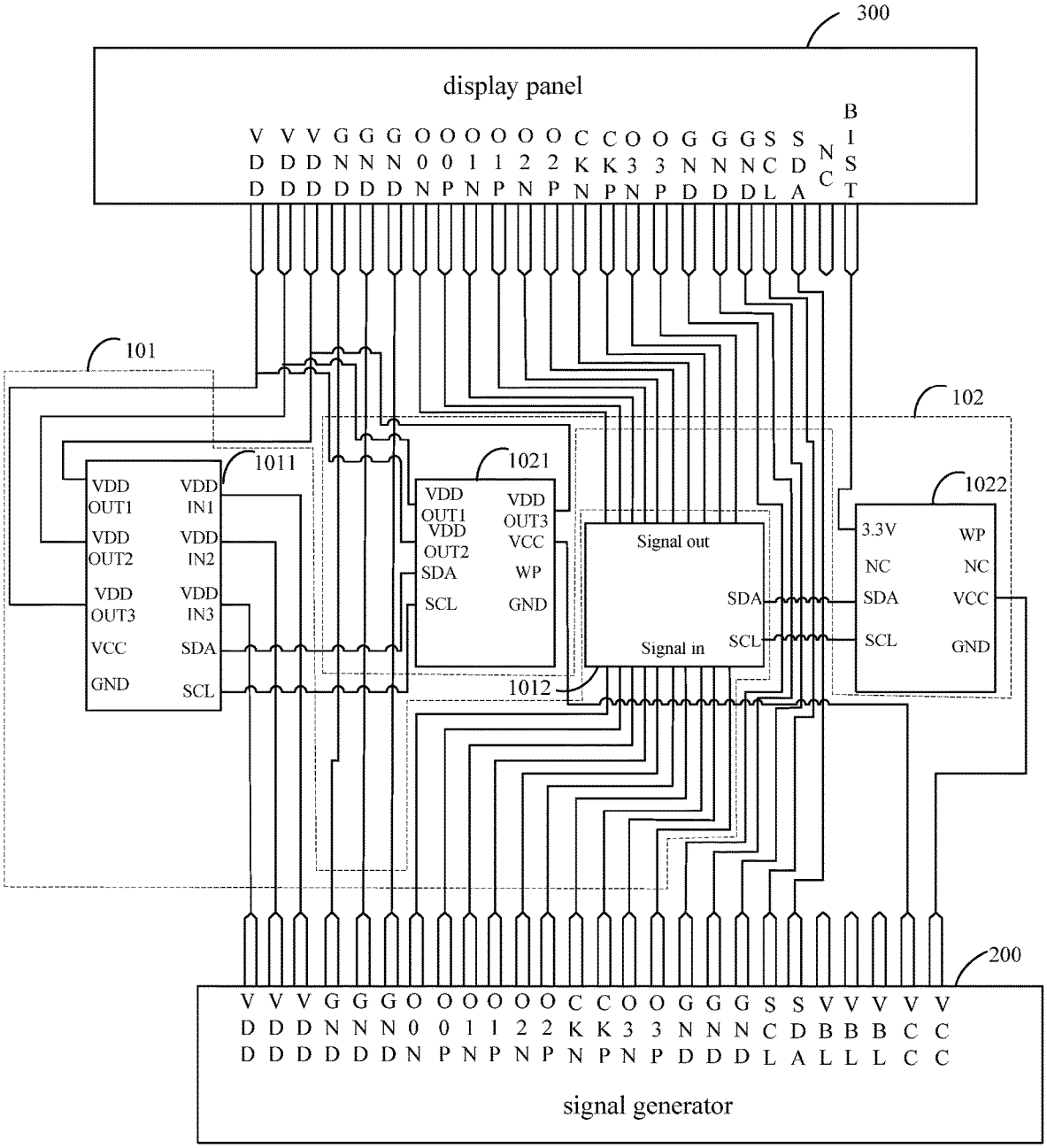
FIG. 6 is a schematic view showing a signal compensation system according to one embodiment of the present disclosure.

By taking an aging process for an OLED LVDS display panel as an example, three VDD power sources are adopted. As shown in FIG. 6, the signal compensator is built in the signal generator, and a connection relationship will be described hereinafter.

Three VDD input pins VDD IN1/2/3 of the first abnormality identification unit 1011 are connected to three VDD output ends of the signal generator respectively, three VDD output pins VDD OUT1/2/3 thereof are connected to three VDD input ends of the display panel respectively, a data signal pin SDA thereof is connected to a data signal pin SDA of the first signal compensation unit 1021, and a clock signal pin SCL thereof is connected to a clock signal pin SCL of the first signal compensation unit 1021. SCL is a clock signal and SDA is a data signal.

Three VDD output pins VDD OUT of the first signal compensation unit 1021 are connected to the three VDD input ends of the display panel respectively, and a VCC power supply pin thereof is connected to a VCC output end of the signal generator.

A signal input end Signal in of the second abnormality identification unit 1012 is connected to four sets of low-voltage differential signal ends (O0N, O0P), (O1N, O1P), (O2N, O2P) and (O3N, O3P) and a set of clock signal ends (CKN, CKP) of the signal generator 200, a signal output end Signal out thereof is connected to four sets of low-voltage differential signal ends (O0N, O0P), (O1N, O1P), (O2N, O2P) and (O3N, O3P) and a set of clock signal ends (CKN, CKP) of the display panel, a data signal pin SDA thereof is connected to a data signal pin SDA of the second signal compensation unit 1022, and a clock signal pin SCL thereof is connected to a clock signal pin SCL of the second signal compensation unit 1022. CKN and CKP are clock signals. O0N, O0P, O1N, O1P, O2N, O2P, O3N and O3P are data signals.

An output pin (e.g., a 3.3V pin in FIG. 6) of the second compensation unit 1022 is connected to a BIST pin of the display panel 300, and a VCC power supply pin thereof is connected to the VCC output end of the signal generator 200.

The signal generator is further provided with some functional pins SDA, SCL pins and ground GND pins. Usually, these signal pins are not likely to be abnormal, and may be directly connected to the display panel 300.

Based on the above-mentioned structure, in the aging process, three VDD signals and an LVDS image display signal may be generated by the signal generator 200. An operating principle of the signal compensator will be described hereinafter.

The first abnormality identification unit 1011 may determine whether or not a voltage value applied to the VDD IN pin is abnormal, when the voltage value is within a standard range, enable the VDD IN pin to be electrically connected to the corresponding VDD OUT pin so as to output the VDD signal generated by the signal generator 200 to the display panel 300, and when the voltage value is not within the standard range, enable the VDD IN pin to be electrically disconnected from the corresponding VDD OUT pin, and output a high level to the SDA and SCL pins of the first signal compensation unit 1021 through its own SDA and SCL pins. When the SDA and SCL pins of the first abnormality identification unit 1011 are determined to be at a high level, the first signal compensation unit 1021 may output the power source signals same as the three VDD signals generated by the signal generator 200 to the three VDD input ends of the display panel 300 through the three VDD OUT pins of the first abnormality identification unit 1011.

The second abnormality identification unit 1012 may determine whether or not the frequency, the peak value and the valley value of the LVDS signal from the input end Signal in are within the standard frequency range, the standard peak value range and the standard valley value range respectively, when the frequency, the peak value and the valley value of the LVDS signal are within the standard frequency range, the standard peak value range and the standard valley value range respectively, enable the input end Signal in to be electrically connected to the corresponding output end Signal out so as to output the image display signal generated by the signal generator 200 to the display panel 300, and when the frequency, the peak value and the valley value of the LVDS signal are not within the standard frequency range, the standard peak value range and the standard valley value range respectively, enable the input end Signal in to be electrically disconnected from the corresponding output end Signal out, and output a high level to the SDA and SCL pins of the second signal compensation unit 1022 through its own SDA and SCL pins. When the SDA and SCL pins of the second abnormality identification unit 1011 are determined to be at a high level, the second signal compensation unit 1022 may apply a voltage (e.g., 3.3V in FIG. 4) to the BIST pin of the display panel 300, so as to enable the display panel 300 to enter the BIST mode and perform self-compensation. According to the embodiments of the present disclosure, it is able to improve the light-on test efficiency and the product quality, thereby to improve the yield of the product.

The first abnormality identification unit 1011, the second abnormality identification unit 1012, the first signal compensation unit 1021 and the second signal compensation unit 1022 may be implemented through an IC chip, as long as connection lines are arranged appropriately.

According to the signal compensator, the signal compensation method and the signal compensation system in the embodiments of the present disclosure, when the waveform of the signal generated by the signal generator for the display panel is abnormal, the signal is not outputted to the display panel, and the signal compensation is performed on the display panel. As a result, it is able to output the normal signal to the display panel continuously and prevent the occurrence of display abnormalities due to the abnormal signal, thereby to improve the light-on test efficiency and the yield of the product.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A signal compensator, comprising an abnormality identification unit and a signal compensation unit, wherein the abnormality identification unit is configured to determine whether or not a waveform of a signal generated by a signal generator is abnormal, when the waveform of the signal is normal, output the signal to a display panel, and when the waveform of the signal is abnormal, stop outputting the signal to the display panel and send an instruction to the signal compensation unit; and the signal compensation unit is configured to perform signal compensation on the display panel in accordance with the instruction received from the abnormality identification unit, wherein the signal generated by the signal generator comprises a power source signal and an image display signal, wherein the waveform of the power source signal is a waveform of a direct-current power source signal, wherein abnormalities of the waveform of the power source signal comprise at least one of the followings:

a time period within which a waveform value of the power source signal increases to a stable value from zero exceeds a first threshold after power supply is started;

a time period within which the waveform value of the power source signal decreases to zero from the stable value exceeds a second threshold after the power supply is stopped; and the stable value of the waveform value of the power source signal is not within a standard range.

2. The signal compensator according to claim 1, wherein the abnormality identification unit comprises a first abnormality identification unit, and the signal compensation unit includes a first signal compensation unit;

the first abnormality identification unit is configured to determine whether or not a waveform of the power source signal generated by the signal generator is abnormal, when the waveform of the power source signal is normal, output the power source signal to the display panel, and when the waveform of the power source signal is abnormal, stop outputting the power source signal and send an instruction to the first signal compensation unit; and the first signal compensation unit is configured to output a signal same as the power source signal to the display panel in accordance with the instruction received from the first abnormality identification unit.

3. The signal compensator according to claim 2, wherein three VDD input pins of the first abnormality identification unit are connected to three VDD output ends of the signal generator respectively, three VDD output pins of the first abnormality identification unit are connected to three VDD input ends of the display panel respectively, a data signal pin of the first abnormality identification unit is connected to a data signal pin of the first signal compensation unit, and a clock signal pin of the first abnormality identification unit is connected to a clock signal pin of the first signal compensation unit; and three VDD output pins of the first signal compensation unit are connected to the three VDD input ends of the display panel respectively.

4. A signal compensator, comprising an abnormality identification unit and a signal compensation unit, wherein the abnormality identification unit is configured to determine whether or not a waveform of a signal generated by a signal generator is abnormal, when the waveform of the signal is normal, output the signal to a display panel, and when the waveform of the signal is abnormal, stop outputting the signal to the display panel and send an instruction to the signal compensation unit; and the signal compensation unit is configured to perform signal compensation on the display panel in accordance with the instruction received from the abnormality identification unit, wherein the signal generated by the signal generator comprises a power source signal and an image display signal, wherein the abnormality identification unit comprises a second abnormality identification unit, and the signal compensation unit includes a second signal compensation unit;

the second abnormality identification unit is configured to determine whether or not a waveform of the image display signal generated by the signal generator is abnormal, when the waveform of the image display signal is normal, output the image display signal to the display panel, and when the waveform of the image display signal is abnormal, stop outputting the image display signal and send an instruction to the second signal compensation unit; and the second signal compensation unit is configured to send an instruction for enabling a built-in self-test (BIST) mode to the display panel in accordance with the instruction received from the second abnormality identification unit.

5. The signal compensator according to claim 4, wherein the waveform of the image display signal is a waveform of a low-voltage differential signal, wherein abnormalities of the waveform of the low-voltage differential signal comprise at least one of the followings:

that a frequency of the waveform of the low-voltage differential signal is not within a standard frequency range;

that a peak value of a waveform value of the low-voltage differential signal is not within a standard peak value range; and that a valley value of the waveform value of the low-voltage differential signal is not within a standard valley value range.

6. The signal compensator according to claim 5, wherein a signal input end of the second abnormality identification unit is connected to four sets of low-voltage differential signal ends and a set of clock signal ends of the signal generator, a signal output end of the second abnormality identification unit is connected to four sets of low-voltage differential signal ends and a set of clock signal ends of the display panel, a data signal pin of the second abnormality identification unit is connected to a data signal pin of the second signal compensation unit, and a clock signal pin of the second abnormality identification unit is connected to a clock signal pin of the second signal compensation unit; and an output pin of the second signal compensation unit is connected to a BIST pin of the display panel.

7. A signal compensation system, comprising a signal generator, a display panel and the signal compensator according to claim 1.

8. The signal compensation system according to claim 7, wherein the signal compensator is built in the signal generator.

9. The signal compensation system according to claim 7, wherein the signal compensator comprises a first abnormality identification unit, a first signal compensation unit, a second abnormality identification unit and a second signal compensation unit;

three VDD input pins of the first abnormality identification unit are connected to three VDD output ends of the signal generator respectively, three VDD output pins of the first abnormality identification unit are connected to three VDD input ends of the display panel respectively, a data signal pin of the first abnormality identification unit is connected to a data signal pin of the first signal compensation unit, and a clock signal pin of the first abnormality identification unit is connected to a clock signal pin of the first signal compensation unit;

three VDD output pins of the first signal compensation unit are connected to the three VDD input ends of the display panel respectively, and a VCC power supply pin of the first signal compensation unit is connected to a VCC output end of the signal generator;

a signal input end of the second abnormality identification unit is connected to four sets of low-voltage differential signal ends and a set of clock signal ends of the signal generator, a signal output end of the second abnormality identification unit is connected to four sets of low-voltage differential signal ends and a set of clock signal ends of the display panel, a data signal pin of the second abnormality identification unit is connected to a data signal pin of the second signal compensation unit, and a clock signal pin of the second abnormality identification unit is connected to a clock signal pin of the second signal compensation unit; and an output pin of the second compensation unit is connected to a built-in self-test (BIST) pin of the display panel, and a VCC power supply pin of the second compensation unit is connected to the VCC output end of the signal generator.

10. The signal compensation system according to claim 9, wherein the first abnormality identification unit, the second abnormality identification unit, the first signal compensation unit and the second signal compensation unit are implemented through an integrated circuit (IC) chip.

11. A signal compensation method, comprising steps of:

determining whether or not a waveform of a signal generated by a signal generator is abnormal, when the waveform of the signal is normal, outputting the signal to a display panel, and when the waveform of the signal is abnormal, stopping outputting the signal to the display panel and sending an instruction; and performing signal compensation on the display panel in accordance with the received instruction, wherein an image display signal is generated by the signal generator, the step of performing the signal compensation on the display panel incudes sending an instruction for enabling a built-in self-test (BIST) mode to the display panel.

12. The signal compensation method according to claim 11, wherein a power source signal is generated by the signal generator, the step of performing the signal compensation on the display panel comprises outputting a signal same as the power source signal to the display panel.

* * * * *